United States Patent [19]

Conrad

[11] Patent Number: 4,830,251

[45] Date of Patent: May 16, 1989

[54] BOTTLE FEEDER

[75] Inventor: George R. Conrad, Dunwoody, Ga.

[73] Assignee: General Electric Company, Mt. Vernon, Ind.

[21] Appl. No.: 226,691

[22] Filed: Aug. 1, 1988

[51] Int. Cl.[4] ..... A61J 9/00

[52] U.S. Cl. ..... 215/10; 215/11.6; 215/252; 215/271

[58] Field of Search ..... 215/10, 11.1, 11.6, 215/252, 271

[56] References Cited

U.S. PATENT DOCUMENTS

| | | | |
|---|---|---|---|
| 1,207,377 | 12/1916 | Decker | 215/11.1 |
| 2,194,004 | 3/1940 | Bukolt | 215/271 |
| 2,738,891 | 3/1956 | Pitto | 215/10 |
| 3,477,603 | 11/1969 | Koll | 215/11.6 |
| 3,485,355 | 12/1969 | Stewart | 215/10 X |
| 4,744,478 | 5/1988 | Hahn | 215/252 |

*Primary Examiner*—Donald F. Norton

*Attorney, Agent, or Firm*—Martin B. Barancik; Joseph T. Eisele

[57] ABSTRACT

A compact stackable bottle feeder which comprises a tamper evident cap which captures a nipple and a pop-up indicator to insure the integrity of the bottle is secured. Upon removal of the cap the tamper evident band remains on the bottle. The pop-up indicator is removed providing an opening in the cap in which the nipple is placed with the cap then used to secure the nipple to the bottle.

14 Claims, 1 Drawing Sheet

BOTTLE FEEDER

FIELD OF THE INVENTION

The present invention relates to a feeding bottle, particularly one which is tamper evident and of a compactable nature.

BACKGROUND AND SUMMARY OF THE INVENTION

There presently exists many types of bottle feeders on the market. Some of these are disposable, others are of the reuseable types. Certain bottles are prefilled with products such as baby formula. Other bottle feeders must be filled by the user.

As in the purchase of most goods, particularly ones which contain food products, the prevention of tampering with the contents is important. Also, in manufacture, shipping and handling of the product, where tampering may not normally occur, sometimes the integrity of the product is lost unknowingly. Accordingly, it is also desirable to have a means which would indicate when this occurs.

In addition, it is also desirable that bottle feeders be of a compact nature for purposes of packaging for sales of multiple units, stocking on shelves and generally, for the end user's convenience in the home or when travelling so as to allow more space for other necessities.

Furthermore, it is also desirable that such bottle feeder be easy to use in addition to being secure or stable in its rest position and not prone to falling over, which commonly occurs with typical bottle feeders.

Accordingly, it is an object of the invention to provide a tamper evident bottle feeder which includes a means of indicating tampering while also insuring that the integrity of the product is maintained.

It is another object to provide for such a feeder which is easy to use, compact in nature, and has improved stability.

The present invention provides for a compact bottle feeder which includes a container member having a low center of gravity for stability. The container includes an open end on which is positioned a tamper evident cap having contained therein a nipple. The cap includes a safety metal pop-up indicator in its center which will indicate whether the contents of the container is still under vacuum as it was packed, thus insuring the integrity of the product. When the cap is twisted off, the tamper evident band detaches therefrom and remains on the neck of the bottle. The nipple which is on the inside of the cap and in a partially collapsed shape is then taken out of the cap. The safety pop-up is then removed and the nipple placed through the opening previously occupied by the safety pop-up. The cap is then screwed down onto the container and is ready for use.

BRIEF DESCRIPTION OF THE DRAWINGS

Thus by the present invention, its objects and advantages will be realized, the description of which should be taken in conjunction with the drawings wherein.

DETAILED DESCRIPTION OF THE PREFERRED EMBODIMENT

Figure 1:
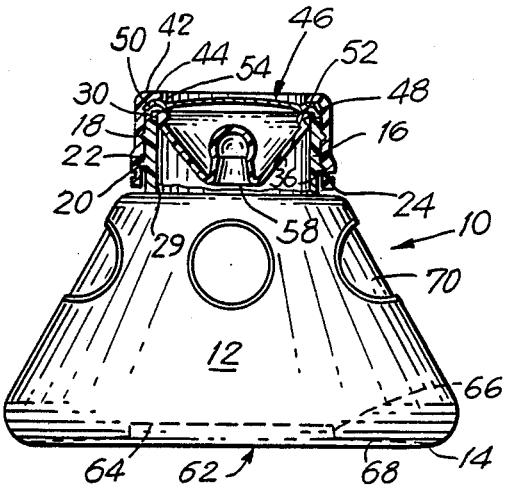
FIG. 1 is a side, partially sectional view of the bottle feeder incorporating the teachings of the present invention.

Turning now more particularly with regard to the drawings, there is shown a bottle feeder 10 for use in baby feeding and the like. The bottle includes a frustoconical container 12 having a closed bottom 14 and a cylindrical neck portion 16 on its opposite thereto to allow the ingress and egress of a liquid such as baby formula. Positioned on the neck portion 16 is a helical thread 18. Located below the helical thread 18 is a beveled retaining means 20 having an inclined surface 22 terminated in a surface 24 which is perpendicular to the neck 16. The retaining means 20 serves to engage a tamper evident band 26 on cap 28 with the inclined surface 22 allowing the band 26 to gradually expand outward upon a threading down of cap 28 to a point where the internal portion 29 of the band 26 snaps under surface 24.

Band 26 is secured to the cap side wall 30 by way of fracturable ribs 32 positioned intermittently between spaces 34 around the cap 28. The thickness of these ribs may be controlled by the degree of notching provided by notch 36 which is located on the internal surface 38 of the side wall 30, immediately above the tamper evident band 26. The cap 28 as well as the container 12, may be made of plastic for ease of fabrication, weight and durability.

Figure 4:
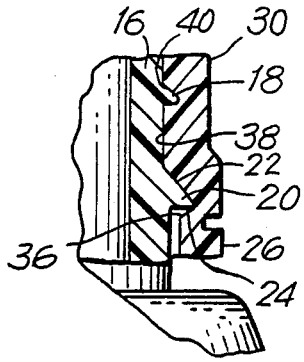
FIG. 4 is an enlarged sectional view of the side wall of the cup on the feeding bottle, incorporating the teachings of the present invention.
Figure 2:
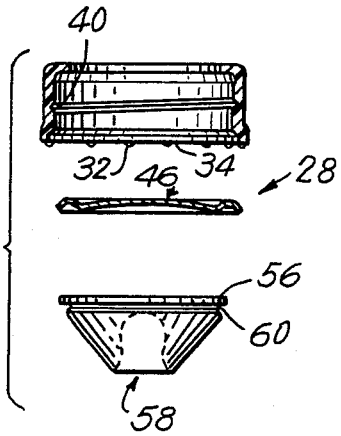
FIG. 2 is a side, partially sectional view of the nipple cap assembly, incorporating the teachings of the present invention.
Figure 3:
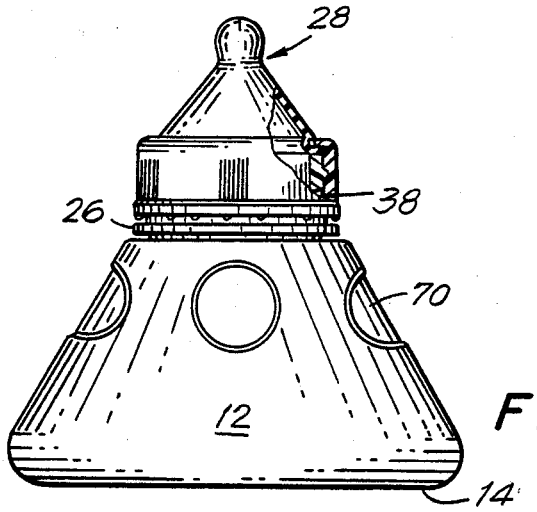
FIG. 3 is a side, partially sectional view of the feeding bottle with the nipple and cap being place thereon, incorporating the teachings of the present invention.

Located above notch 36 is a helical thread 40 which compliments thread 18 and allows the cap 28 to be threaded down and off of the bottle 10. Once the cap 28 has been threaded in place as shown in FIGS. 1 and 4, a threading off thereof causes the retaining means 20 to engate the band 26 causing a fracture of the ribs 32 and the retainment of the band 26 on the neck 16 of the bottle 10.

The top 42 of cap 28 includes a flange 44 positioned about a circular opening. Positioned on the inside of the cap 28 is a pop-up indicating member or disk 46 which is preferably made of metal. Member 46 is circular having its outer edge 48 positioned in a circular groove 50 located in the cap 28. Flange 52 on member 46 serves to abut flange 44 with a circular indentation 54 engaging the flange 56 on a collapsed nipple 58.

Nipple 58 may be any standard nipple suitable for that purpose. The external diameter of flange 56 and that of groove 60 in the nipple should be such that when the pop-up member 46 is removed, the nipple 58 can be inserted into opening 46 until groove 60 snaps in about flange 44. Flange 56 will then be in abutment with the underside of flange 44. The cap 28 with the nipple can then be screwed into place on the neck 16 of the bottle 10.

The contents of the bottle 10 are contained in it under a negative pressure or vacuum. The pop-up member 46 is flexible and sucked down to a certain extent in its center under this pressure. If the integrity of the sealed bottle is broken for any reason, member 46 pops up to indicate this.

As can be seen, the large base of the bottle 10 provides stability and is not easily knocked over. In addition, located in the base is a circular recession 62, the deepest part of which at 64 is at a diameter equal to the diameter of the cap 28. Adjacent to this is a tapering side wall 66 which in turn is coupled to a gradually tapering area 68. This recess area provides a means of stacking one bottle on top of the other with the cap of one bottle and the recess of another coupled in a loose friction fit. This is convenient in packaging of multiple units, shelving and use by the end user.

In addition, to aid in gripping the bottle, finger depressions 70 can be molded into the bottle for this purpose.

Thus by the present invention, its objects and advantages are realized, and although a preferred embodiment has been disclosed and described in detail herein, its scope should not be limited thereby, rather its scope should be determined by that of the claims.

What is claimed is:

1. A bottle feeder comprising: a container for holding a liquid, said container having a cylindrical neck with an opening therein to allow the ingress and egress of a liquid, a helical thread located on said neck with a retaining means positioned therebelow;

a cap comprising a top and a downwardly extending side wall coupled to a tamper evident band;

a helical thread located on the side wall so as to allow the threading down and threading off of the cap from the neck of the container, said top of the cap having a circular opening in which is positioned a detachable indicating means capable of indicating if the integrity of the container has been disturbed once the feeder has been sealed under pressure;

nipple disposed in the cap, said nipple having a circular flange larger than the opening in the top of the cap and larger than the opening in the neck of the container such that when the cap is threaded down on the container it captures the nipple therein with the tamper evident band captured by the retaining means; and upon removal of the cap, the retaining means causes the separation of the tamper evident band from the side wall and causes the indicating means to indicate that the seal of the bottle has been broken, the indicating means can then be removed with the nipple placed through the opening in the top of the cap with the cap threaded down on the container neck for use.

2. The invention in accordance with claim 1 wherein said container and cap are made from a plastic material and said indicating means comprises a flexible metal disk.

3. The invention in accordance with claim 2 wherein said tamper indicating band is coupled to the side wall by a plurality of ribs integrally formed with said band and side wall.

4. The invention in accordance with claim 3 wherein said disk is engageable by the application of a negative pressure on the container's interior.

5. The invention in accordance with claim 4 wherein said container is formed in a frustoconical shape having an enlarged base opposite the neck.

6. The invention in accordance with claim 5 wherein said base includes a circular recess area which facilitates stacking a plurality of bottles.

7. The invention in accordance with claim 6 wherein said recess has a diameter approximately equal to the top of the cap allowing a friction fit between the recess of one bottle and the cap of another.

8. The invention in accordance with claim 7 wherein said base includes an area adjacent said recess which outwardly tapers therefrom.

9. The invention in accordance with claim 8 wherein said container includes a plurality of indentations that facilitate grasping the container.

10. The invention in accordance with claim 1 wherein said container is formed in a frustoconical shape having an enlarged base opposite the neck.

11. The invention in accordance with claim 10 wherein said base includes a circular recess area which facilitates stacking a plurality of bottles.

12. The invention in accordance with claim 11 wherein said recess has a diameter approximately equal to the top of the cap allowing a friction fit between the recess of one bottle and the cap of another.

13. The invention in accordance with claim 12 wherein said base includes an area adjacent said recess which outwardly tapers therefrom.

14. The invention in accordance with claim 13 wherein said container includes a plurality of indentations that facilitate grasping the bottle.

* * * * *